United States Patent [19]

Schimko

[11] 4,281,523

[45] Aug. 4, 1981

[54] ELECTRICALLY CONTROLLED SELECTING DEVICE FOR THE NEEDLES OF A FLAT KNITTING MACHINE

[75] Inventor: Reinhold Schimko, Aalen, Fed. Rep. of Germany

[73] Assignee: Universal Maschinenfabrik Dr. Rudolf Schieber GmbH & Co. KG, Westhausen, Fed. Rep. of Germany

[21] Appl. No.: 83,732

[22] Filed: Oct. 10, 1979

[30] Foreign Application Priority Data

Oct. 10, 1978 [DE] Fed. Rep. of Germany ..... 2844135

[51] Int. Cl.[3] ..... D04B 15/00

[52] U.S. Cl. ..... 66/232; 66/75.2

[58] Field of Search ..... 66/232, 75.2, 78

[56] References Cited

U.S. PATENT DOCUMENTS

| | | | |
|---|---|---|---|
| 2,157,989 | 5/1939 | Lawson | 66/75.2 |
| 3,340,708 | 9/1967 | Krause | 66/75.2 |
| 3,693,377 | 9/1972 | Hadam | 66/75.2 |

FOREIGN PATENT DOCUMENTS

| | | | |
|---|---|---|---|
| 1276857 | 9/1968 | Fed. Rep. of Germany | 66/75.2 |
| 2646410 | 4/1978 | Fed. Rep. of Germany | 66/75.2 |
| 2842054 | 10/1979 | Fed. Rep. of Germany | 66/75.2 |
| 2855896 | 12/1979 | Fed. Rep. of Germany | 66/75.2 |
| 435528 | 10/1967 | Switzerland | 66/75.2 |

*Primary Examiner*—Ronald Feldbaum

*Attorney, Agent, or Firm*—Sughrue, Mion, Zinn, Macpeak and Seas

[57] ABSTRACT

In a flat knitting machine having an electrically controlled selecting device for the needles, the selecting jacks (11) controlling the needles are movably mounted in the needle grooves of the needle bed in the same direction as the needles and include staggered feet which form foot rows in the longitudinal direction of the needle bed. For each of the foot rows a control element is provided on the carriage, which can be moved into and out of operative position between adjacent feet of a foot row. For the purpose of increasing the performance of the flat knitting machine and to achieve a simple and easy carriage structure, all control elements (2) are preferably formed as light double-armed levers and are pivotably mounted on an axle attached to the carriage and extending transversely to the longitudinal direction of the needle bed. These double-armed levers are mounted in such a way that the inclined disabling surfaces provided on the control elements can be pivoted into and out of position for engagement with the feet of the selecting jacks to disable the selecting jacks.

1 Claim, 3 Drawing Figures

ELECTRICALLY CONTROLLED SELECTING DEVICE FOR THE NEEDLES OF A FLAT KNITTING MACHINE

BACKGROUND OF THE INVENTION

The invention relates to an electrically controlled selecting device for the needles of a flat knitting machine in which the needle selecting jacks are mounted so as to be movable in the same direction as the needles in the needle grooves of the needle beds. The selecting jacks include staggered feet which form foot rows in the longitudinal direction of the needle bed. A control element is provided on the carriage for each of the foot rows and can be moved into and out of position for engaging selected feet in a foot row.

In the selecting device of U.S. Pat. No. 3,805,558, the control elements for the selecting jacks are moved basically vertically toward or away from the needle bed. This arrangement requires an extremely high switching force and a long switching period which has a disadvantageous effect on the rapidity of performance of the flat knitting machine.

In another known device for the selection of needles of an electrically controlled flat knitting machine, the elements controlling the needles are lowered into the needle bed or lifted away therefrom, whereby the control elements in the bed are moved in the direction of movement of the needles. This provides an advantageous structure for the carriage, particularly if the control elements are pivoted. The manufacture of the needle beds, however, is more complicated and gives more opportunity for lack of precision as does the manufacture of needle beds in which all elements are mounted in the needle groove, i.e., the needles, the pattern jacks and the selecting jacks are disposed in continuous uniformly deep grooves.

German DOS No. 2,261,973 and German DOS No. 2,633,338 each disclose a selecting apparatus for the needles of circular knitting machines, in which stationary levers are provided on an axle, which levers selectively press the needles or selecting jacks into the needle grooves and thereby prevent a catching of the feet of the needles or the selecting jacks by their own representative lock elements. The disabling of the needles or selecting jacks does not take place directly by inclined disabling surfaces on the levers, but rather by their own additional lock elements. This type of device would be too heavy and complicated to be used on the carriage of a flat knitting machine.

SUMMARY OF THE INVENTION

The basic objective of the invention is to create a device of the above-described type in which the performance of the flat knitting machine can be increased with a simple and easily constructed carriage.

This objective is attained according to the invention in that all control elements are pivotally mounted on an axle attached to the carriage and extending transversely to the longitudinal direction of the needle bed in such a manner that inclined disabling surfaces provided on the control elements can be pivoted into and out of position for engagement with the feet of a foot row of the selecting jacks.

If needle selection is to be possible in both operating directions of the carriage, two such selecting devices according to the invention can be provided for each knitting system.

The control elements of the apparatus according to the invention can be pivoted in such a manner that their inclined disabling surfaces either bear against the feet of the selecting jacks or in the opposite position slide past them. To achieve the lowest possible mass of the control elements, only sufficient material is provided at all positions of the control elements to insure the stability of the control element. The smaller the mass of the control elements and the higher the switch speed of the magnets, the lower is the number of parallel foot rows of the selecting jacks that can be provided. By this means, the distance between adjacent feet in a row is substantially decreased whereby the needle bed width can be substantially decreased thus significantly reducing the size and mass of the locks and carriage.

Overall, these structural characteristics result in the desired increased performance of the flat knitting machine, especially with fine separations where only small distances are available between needle grooves.

The foregoing and other objects, features and advantages of the invention will be apparent from the following more particular description of a preferred embodiment of the invention as illustrated in the accompanying drawings.

DETAILED DESCRIPTION OF THE PREFERRED EMBODIMENT

Figure 2:
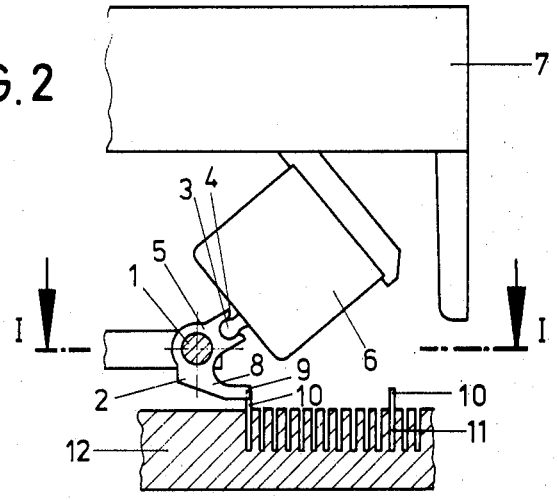
FIG. 2 is a sectional view through the needle bed along the line II—II of FIG. 1 showing projecting feet of the selecting jacks, a carriage with a control magnet and a pivotable disabling element.
Figure 1:
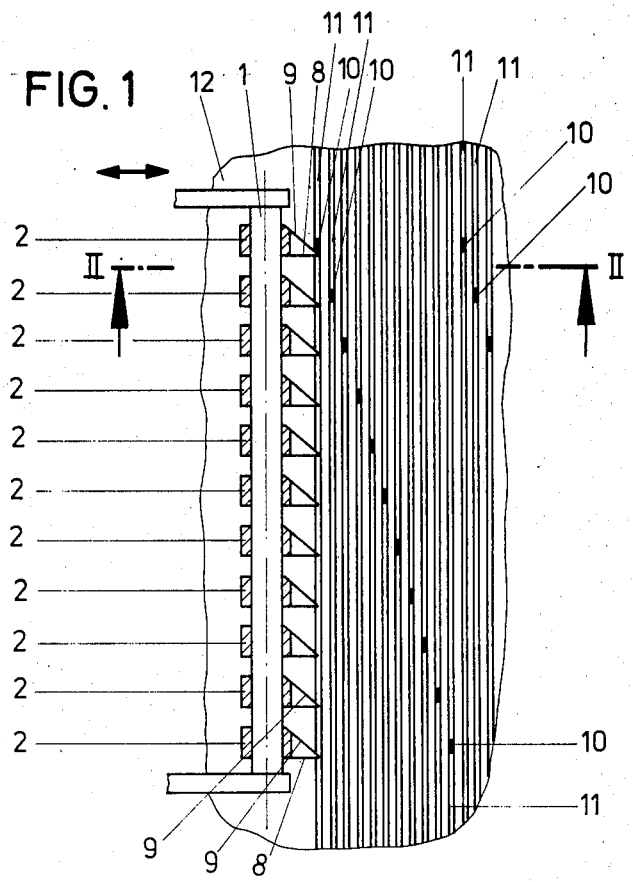
FIG. 1 is a top view of a portion of a needle bed with a selecting device for the needles arranged thereabove, cut along the line I—I in FIG. 2 illustrating the staggered feet of the selecting jacks.
Figure 3:
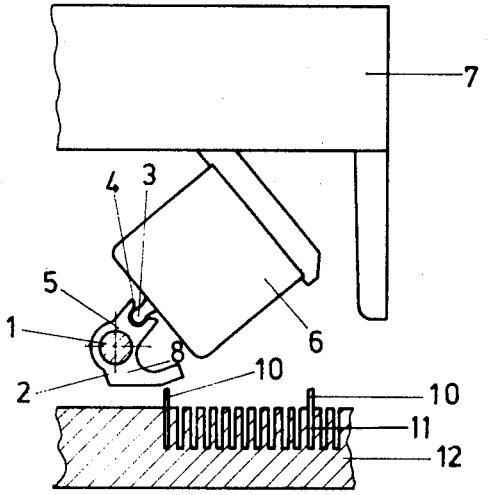
FIG. 3 is an illustration similar to FIG. 2 but with the control element pivoted upwardly to pass over the feet of the selecting jacks.

In the apparatus illustrated in FIGS. 1 through 3, an axle 1 is disposed transversely to the longitudinal direction of the needle bed. Control elements 2 are pivotally mounted on the axle 1. The control elements 2 have the shape of double-armed levers. One such lever arm 5 includes a fork 4, into which the pivoted armature 3 of a control magnet 6 enters.

The other lever arm 8 of the control element 2 includes an inclined disabling surface 9, which can come into engagement with the feet 10 of selecting jacks 11 slidable in the needle bed 12 when the lever arm 8 is pivoted toward the needle bed 12.

The axle 1 together with the control elements 2 and the control magnets 6 are attached to the carriage 7 and reciprocate above the needle bed 12 in the direction of the double arrow in FIG. 1.

FIG. 2 shows a control element 2 in the position for engagement with the feet 10 of the selecting jacks 11 while FIG. 3 shows a control element 2 in its upwardly pivoted position in which it passes above the feet 10 of the selecting jacks 11.

Two selection devices with oppositely directed inclined disabling surfaces 9 are provided for in each knitting member for a needle selection in opposite directions of movement of the carriage.

The control elements 2 pivotally mounted on the axle 1 can be pivoted into the position according to FIG. 2 by the control magnet 6, which includes a pivoted armature 3 which engages the fork 4 of the lever arm 5. In the position shown in FIG. 2 the lever arm 8 can engage the feet 10 of the selecting jacks 11 by means of the inclined disabling surface 9. Each control magnet 6 can pivot the control element associated therewith in an upward direction by means of its pivoted armature 3 as is shown in FIG. 3 so that the lever arm 8 with its inclined disabling surface 9 can pass above the feet 10.

The selecting jacks 11 are placed in the needle bed 12 in a staggered arrangement in such a manner that in one foot row sufficient space is present between adjacent feet 10 in the longitudinal direction of the needle bed to allow switching of the control element 2.

The knitting speed of the flat knitting machine depends on the distance between the feet 10 and the switch time of the control elements 2. The distance between the feet 10, which is also dependent on the relative fineness of the machine, becomes larger when more foot rows are included. The number of foot rows, however, is limited in that the structural size of the carriage 12 should be held as small as possible in order to reduce mass and production costs. Thus, in order to achieve a high performance of the machine, the switch time of the control magnet 6 should be brought to a minimum so that the distance between the feet in one row can be held as small as possible.

Since the structural size of the control magnets 6 on the carriage 12 is limited because of the size of the overall carriage and the performance design of the control magnets 6 is limited because of the costs of the associated control mechanism, the mass of the control elements 2, which must be accelerated by the control magnets 6, must be reduced as much as possible. The control elements 2 are formed so that only that amount of material is present at any position as is necessary for the reliable disabling of the selecting jacks and to maintain stability.

In addition to the pivotable control elements 2, lock elements (not shown) are also provided on the carriage 7, which return the feet 10 of the selecting jacks 11 into the basic position as shown in FIG. 1 before a selection occurs by means of control elements 2 being pivoted according to function and pattern.

While the invention has been particularly shown and described with reference to a preferred embodiment thereof, it will be understood by those in the art that various changes may be made in form and details without departing from the spirit and scope of the invention.

What is claimed is:

1. An electrically controlled selection device for the needles of a flat knitting machine having a needle bed with a plurality of grooves and a carriage, a plurality of selection jacks for controlling the needles being mounted in said needle grooves so as to be movable in the same direction as the needles, said selection jacks including staggered feet arranged to form foot rows in the longitudinal direction of the needle bed, a plurality of advancing cam elements, one for each foot row, being mounted on said carriage for advancing said selection jacks in the direction of said needles and being shiftable into and out of engagement with said feet between adjacent feet of a foot row by means of a control magnet, each cam element comprising a two arm lever pivotally mounted on an axle attached to said carriage and extending parallel to said needle grooves, one arm of said two arm lever being provided with inclined advancing surfaces for engagement with said feet to advance said selection jacks toward said needles and the other lever arm having a fork and a control magnet associated with each cam element having a pivoted armature disposed in engagement with said fork.

* * * * *